US006945492B2

(12) United States Patent
Koreska

(10) Patent No.: US 6,945,492 B2
(45) Date of Patent: Sep. 20, 2005

(54) REEL ARRANGEMENT

(75) Inventor: Peter Koreska, Vienna (AT)

(73) Assignee: Kores Holding Zug AG, Zug (CH)

( * ) Notice: Subject to any disclaimer, the term of this patent is extended or adjusted under 35 U.S.C. 154(b) by 0 days.

(21) Appl. No.: 10/398,710

(22) PCT Filed: Oct. 3, 2001

(86) PCT No.: PCT/AT01/00312

§ 371 (c)(1),
(2), (4) Date: Apr. 9, 2003

(87) PCT Pub. No.: WO02/30797

PCT Pub. Date: Apr. 18, 2002

(65) Prior Publication Data

US 2004/0031873 A1 Feb. 19, 2004

(30) Foreign Application Priority Data

Oct. 9, 2000 (AT) ..... A 1712/2000

(51) Int. Cl.[7] ..... B65H 18/08; B32B 31/00

(52) U.S. Cl. ..... 242/538.1; 242/588.6; 156/577; 156/579; 156/540

(58) Field of Search ..... 242/538.1, 588.6; 156/577, 579, 540

(56) References Cited

U.S. PATENT DOCUMENTS 5,310,445 A 5/1994 Tucker
5,430,904 A 7/1995 Ono et al.
5,759,341 A * 6/1998 Kobayashi ..... 156/540
6,062,286 A * 5/2000 Koyama et al. ..... 156/540
6,321,816 B1 * 11/2001 Koreska ..... 156/577
6,521,045 B1 * 2/2003 Koyama et al. ..... 118/257

FOREIGN PATENT DOCUMENTS

DE 4104331 A1 8/1992
DE 41 04 331 A 1 8/1992
EP 0 770 572 A 5/1997
EP 0 905 074 A 3/1999
WO WO 99/01368 1/1999

* cited by examiner

*Primary Examiner*—Kathy Matecki
*Assistant Examiner*—E. Langdon
(74) *Attorney, Agent, or Firm*—Pillsbury Winthrop Shaw Pittman LLP

(57) ABSTRACT

A reel arrangement (1) for a device for transferring a film present on one side of a film strip to a substrate, said reel arrangement comprising a supply reel (3) for the film strip, a take-up reel (2) coaxial with said supply reel (3) and provided for the film strip after transfer of the film, the supply and takeup reels (3, 2) being interengaged by means of a slipping clutch, and an elastic spring element (8), preferably a helical compression spring, acting in axial direction of the common axis of rotation of the supply and take-up reels (3, 2) being provided to realize the slipping clutch, and the supply reel (3) being non-rotationally connected to a clutch part (5) passing through an inner aperture of the take-up reel (2), which clutch part has a frictional face (15') associated with the supply reel (3), which frictional face is resiliently pressed towards a frictional face (14) of the take-up reel (2) with the help of the elastic spring element (8).

8 Claims, 1 Drawing Sheet

REEL ARRANGEMENT

Figure 1:
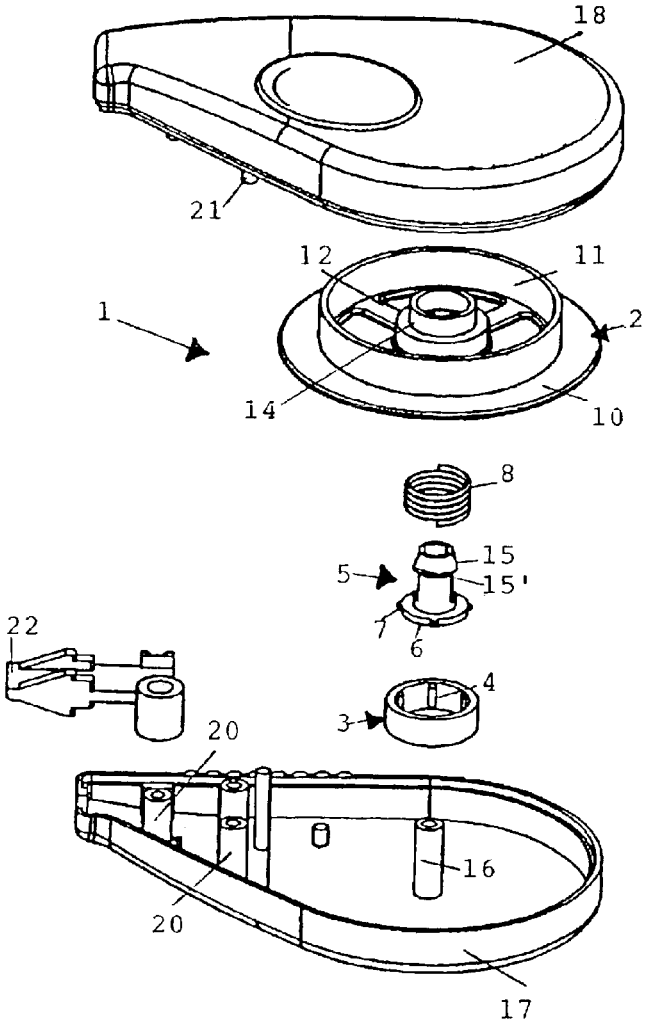

This application is the National Phase of International Application PCT/AT01/00312, filed Oct. 3, 2001 which designated the U.S., which, in turn was based on Austrian Application No. A 1712/2000, filed Oct. 9, 2000, the entire contents of both of which are incorporated herein by reference.

The invention relates to a reel arrangement for a device for transferring a film present on one side of a film strip to a substrate, said reel arrangement comprising a supply reel for the film strip, a take-up reel coaxial with said supply reel, provided for the film strip after transfer of the film, the supply and take-up reels being interengaged by means of a slipping clutch, and an elastic spring element, preferably a helical compression spring, for realizing the slipping clutch and acting in the axial direction of the common axis of rotation of said supply and take-up reels.

Such a reel arrangement is, e.g., known from U.S. Pat. No. 5,430,904 A, wherein a friction ring is provided as a clutch element between the two reels, at the surface of which linear webs projecting in radial direction are provided. For the frictionally engaged connection between the two reels, a helical compression spring is provided which is arranged between the housing and the take-up reel so that the take-up reel is pressed against the supply reel, or against the friction ring arranged therebetween. However, if pressure is applied to the housing from the outside thereof, the force applied by the helical compression spring will be increased which may lead to an unintentional blocking of the slipping clutch and, as a consequence thereof, to rupture of the strip.

In DE 41 04 331 A1, a hand tool for transferring an adhesive film is shown in which a supply and take-up reel are coaxially arranged and coupled with each other via a slipping clutch active in the direction of rotation. In that instance, a foam material ring disk is provided as the friction clutch element between the two reels.

In WO 99/01368 A, a reel arrangement is shown in which the slipping clutch between a supply reel and a coaxial take-up reel is realized by means of projections provided on radially resilient arms, which projections engage into a front-side cam curve guide of the other reel. This does result in a reel arrangement in which the reeling up of the film strip on the take-up reel after transfer of the film will reliably be ensured, yet a comparatively high production precision will be required as regards the engagement projections and the front-side curve guide. This will lead to a relatively complex construction and thus, to comparatively high production costs.

On the other hand, from U.S. Pat. No. 5,310,445 A, a reel arrangement is known in which take-up and supply reels arranged side by side are coupled with each other by meshing toothed wheels. To allow for different rotational speeds of the two reels, the toothed wheel associated to the take-up reel is designed as a slipping plate. To obtain a reliable slipping clutch between the take-up reel and the slipping plate, a helical compression spring is provided between a housing wall and the take-up reel, whereby the take-up reel is pressed towards the slipping plate to thus realize the slipping clutch. This design thus also causes comparatively high construction expenditures.

It is now an object of the invention to provide a reel arrangement of the initially defined type, in which the slipping clutch between the two coaxially arranged reels is realized by a simple construction and in a cost-effective manner. Furthermore, a reel arrangement is to be provided in which, particularly also when pressure is applied to the housing of the reel arrangement, a blocking between the two reels will reliably be avoided.

The inventive reel arrangement of the initially defined type is characterized in that the supply reel is non-rotationally connected to a clutch part passing through an inner aperture of the take-up reel, which clutch part has a frictional face associated with the supply reel, which frictional face is resiliently pressed towards a frictional face of the take-up reel by means of the elastic spring element. By means of the clutch part mounted in the interior of the housing, which clutch part is not in contact with the housing, in case of a pressure application on the housing from the outside thereof, the release moment caused by the spring on the clutch part will not be influenced by the external pressure forces, and the risk of a strip rupture due to a blocked take-up or supply reel will effectively be avoided in this instance. The provision of a helical spring is suitable in this instance, since the latter will be secured in its position in a simple manner also on account of its cylindrical shape by enclosing a hub of the supply or take-up reel, respectively.

In order to apply at any time the respective frictional force for a slipping clutch between the frictional faces via the elastic spring element—with changed drive conditions resulting, depending on how much film strip is on the take-up reel and how much film strip is on the supply reel—it is advantageous if the clutch part is non-rotationally connected to the supply reel by means of an axially displaceable groove-tongue connection. In this manner, the reeling up and tensioning of the film strip can reliably be ensured right from the start of the reel-off procedure, i.e. when the entire film strip is still on the supply reel, until the end of the reel-off procedure, when the entire film strip is present on the take-up reel.

For a structurally simple, reliable non-rotational connection between the clutch part and the supply reel it is also suitable if the clutch part comprises several radial projections on its outer side, and the cylindrical supply reel comprises several grooves on its inner side so as to realize the groove-tongue connection.

For forming a frictional face on the clutch part, it is suitable if the clutch part comprises a widened snap-in head abutting on the take-up reel in the assembled state, which latching head preferably has a conically tapering shape. On account of the conically tapering shape of the latching head, the clutch part can simply be inserted through a (hub) cylinder forming the inner aperture of the take-up reel.

To obtain a reliable slipping clutch between the two reels, on the one hand, and a compact shape of the reel arrangement, on the other hand, it is, moreover, advantageous if the front side of the head of the clutch part facing the take-up reel forms the one frictional surface, which is engaged with the other frictional surface formed by an end face of a cylindrical jacket part enclosing the inner aperture of the take-up reel. In particular, the head of the clutch part can be in engagement with an end face inner stepped portion of the cylindrical jacket part so as to obtain a low structural height of the reel arrangement.

Furthermore, for a compact, space-saving reel arrangement it is advantageous if the helical compression spring surrounds the cylindrical jacket part of the take-up reel and is arranged under bias between the take-up reel, and an end flange of the clutch part that faces away from the take-up reel. For this purpose, the cylindrical jacket of the take-up reel may also have a recess of U-shaped cross-section, in which the helical spring can space-savingly be housed.

When the supply and take-up reels are mounted so as to be rotatable about a pin that is integrally connected to a housing lower part, a reel arrangement will result with an extremely low number of individual parts, which in turn will lead to a suitable production and simple mounting.

To prevent a pressure force acting from the outside on the housing walls surrounding the reel arrangement from pressing the take-up and supply reels against each other and, thus, rendering the slipping clutch provided therebetween ineffective, it is advantageous if in an assembled state of housing lower part with housing upper part, the pin substantially extends as far as to the oppositely arranged inner side of the housing upper part, or to a projection provided thereon, respectively. Thus, any unintentional static-frictional connection between the take-up and supply reels can reliably be prevented, such a blocking possibly leading to an overtensioning of the film strip and thus, to a rupture of the strip.

The invention will now be explained in more detail and with reference to a preferred exemplary embodiment illustrated in the drawing to which, however, it shall not be limited. In detail, in the drawings, FIG. 1 shows an exploded illustration of a reel arrangement with an associated, two-part housing; and FIG. 2 shows a sectioned view of the reel arrangement within the assembled housing, the sectional plane extending through a pin provided as axis of rotation fo the coaxial reels.

Figure 2:
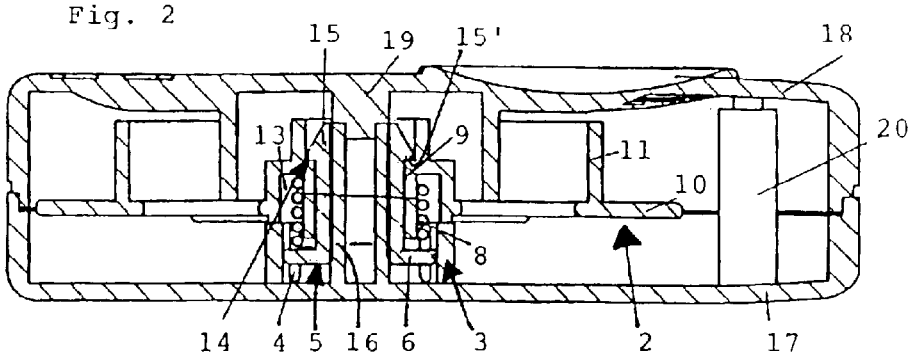

In FIGS. 1 and 2, a reel arrangement 1 is shown which comprises a take-up reel 2 and a supply reel 3 coaxial therewith. The annular supply reel 3 is provided with several vertical grooves 4 at its inner side. A clutch part 5 is inserted in this supply reel 3. At a front-side end flange 6 of the clutch part 5, several radial projections 7 are provided which, upon insertion in the supply reel 3 having the grooves 4, will provide for a groove-tongue-connection for a non-rotational connection between the clutch part 5 and the supply reel 3. In this manner, the clutch part 5 is mounted to be shiftable in the vertical, i.e. axial, direction relative to the supply reel 3.

Between the supply reel 3 and the take-up reel 2, a helical spring 8 is provided, which, under bias, presses against the take-up reel 2, on the one hand, and against the end flange 6 of the clutch part 5, on the other hand. To accommodate the helical spring 8, a cylindrical jacket part 9 defining the inner aperture of the take-up reel 2 is surrounded by a recess 13 so that a hub part of U-shaped cross-section will result. Moreover, at its upper side, the cylindrical jacket part 9 has a stepped portion 14 on which, in the assembled state, a conically tapering, widened head part 15 of the clutch part 5 of hook-shaped cross-section and including an axis-parallel gap will abut with its lower face 15' after having snapped in.

Thus, the lower face 15' of the widened head part 15 is pressed by the helical spring 8 towards the stepped portion 14 of the cylindrical jacket part 9, whereby the clutch part 5 and the take-up reel 2 are interconnected via a slipping clutch. The stepped portion 14 and the lower face 15' of the head part form the two frictional faces of the slipping clutch. The non-rotational groove-tongue connection 4, 7 between the clutch part 5 and the supply reel 3 will have the effect that the slipping clutch will in fact act between the two reels 2, 3, i.e. there exists a frictional engagement between the take-up reel 2 and the supply reel 3, a static friction being present up to a certain tension of the film strip (not illustrated), which static friction at a certain limit value of the strip tension, will change to a slipping friction. In this manner it is ensured that the strip which arrives from the supply reel 3, after a film provided on one side of the strip has been delivered therefrom in the region of a transfer head including an application tongue 22 in a per se conventional manner to a substrate, will reliably be reeled up by the take-up reel 2 under maintenance of a pre-determined tension.

The take-up reel 2 comprises an annular disk 10 which adjoins a flange part 11 of the take-up reel 2 that is provided with several spokes 12 so as to avoid slipping off of the film strip while it is reeled up. The cylindrical jacket part 9 that defines the inner aperture joins to the spokes 12 of the take-up reel 2.

The clutch part 5 and, thus, the reel assembly group, is rotatably mounted on a pin 16 which is integrally provided with a housing lower part 17 partially enclosing the reel arrangement 1.

The pin 16 extends in the interior of housing lower part 17, and in its assembled state it gets into contact with a counter-pin projection 19 provided on a housing upper part 18. In addition to a centering function, the connection between the pin 16 and the counter-pin projection 19 in particular serves to avoid the possibility of the supply reel 3 and the take-up reel 2 being pressed against each other under deformation, if a pressure force were externally applied to the housing parts 17, 18 in the region of pin 16. Otherwise, such a pressure force could block the slipping clutch between the supply reel 3 and the take-up reel 2, in the case that the housing upper part 18 is pressed against the take-up reel 2 arranged on top, whereby, in turn, slipping of the take-up reel 2 relative to the supply reel 3 would no longer be possible, which might result in a rupture of the film strip.

The housing lower part 17 comprises several sleeve-shaped receiving means 20 extending into the housing interior, positioning pins 21 provided on the housing upper part 18 engaging therein so as to keep together the two housing halves 17, 18 which enclose the reel arrangement 1. On one of the sleeve-shaped receiving parts 20, the transfer head including the transfer tongue 22 is mounted, over which the film strip is guided so as to deliver the film to a substrate.

What is claimed is:

1. A reel arrangement for a device for transferring a film present on one side of a film strip to a substrate, said reel arrangement comprising a supply reel for the film strip, a take up reel coaxial with said supply reel and provided for the film strip after transfer of the film, the supply and take up reels are interengaged by means of a slipping clutch, the supply reel being non rotationally connected to a clutch part passing through an inner aperture of tire take up reel, wherein the clutch part is mounted inside a housing and that for realizing the slipping clutch, an elastic helical compression spring acting in the axial direction of the common axis of rotation of said supply and take up reels is provided, a frictional face of the clutch part associated with the supply reel is resiliently pressed against a frictional face of the take up reel by said elastic helical compression spring.

2. A reel arrangement according to claim 1, wherein the clutch part is non rotationally connected to the supply reel by means of an axially displaceable groove tongue connection.

3. A reel arrangement according to claim 2, wherein the clutch part comprises several radial projections on an outer side, and the cylindrical supply reel comprises several grooves on an inner side so as to constitute the groove tongue connection.

4. A reel arrangement according to any one of claims 1 to 3, wherein the clutch part comprises a widened latching head abutting on the take up reel in the assembled stare, wherein the latching head has a conically tapering shape.

5. A reel arrangement according to claim 4, wherein the front side of the latching head of the clutch part facing the take up reel forms the one frictional surface, which is engaged with the other frictional surface formed by an end face of a cylindrical jacket part enclosing the inner aperture of the take up reel.

6. A reel arrangement according to claim 5, wherein the helical compression spring surrounds the cylindrical jacket part of the take up reel and is arranged under bias between the take up reel and an end flange of the clutch part that faces away from the take up reel.

7. A reel arrangement according to claim 6, wherein the supply and take up reels are mounted so as to be rotatable about a pin that is integrally connected to a housing lower part.

8. A reel arrangement according to claim 7, wherein in an assembled state of housing lower part with housing upper part, the pin substantially extends as far as to the oppositely arranged inner side of the housing upper part, or a projection provided thereon, respectively.

* * * * *